US008522864B1

(12) United States Patent
Miller

(10) Patent No.: US 8,522,864 B1
(45) Date of Patent: Sep. 3, 2013

(54) STRIPPER BLOW OUT PREVENTER FOR SMALL DIAMETER OIL FIELD TUBING OR SMALL DIAMETER POLISHED RODS

(76) Inventor: James Otis Miller, Tomball, TX (US)

( * ) Notice: Subject to any disclaimer, the term of this patent is extended or adjusted under 35 U.S.C. 154(b) by 25 days.

(21) Appl. No.: 13/117,958

(22) Filed: May 27, 2011

(51) Int. Cl.
*E21B 19/00* (2006.01)

(52) U.S. Cl.
USPC ..... 166/84.4; 166/368; 166/88.1; 166/84.2; 166/84.3; 166/84.1

(58) Field of Classification Search
USPC ..... 166/368, 88.1, 84.1, 84.2, 84.3, 84.4
See application file for complete search history.

(56) References Cited

U.S. PATENT DOCUMENTS

| | | | | |
|---|---|---|---|---|
| 2,278,050 | A | 3/1942 | Allen et al. | |
| 3,102,709 | A | 9/1963 | Allen | |
| 3,379,255 | A | 4/1968 | Burns, Jr. et al. | |
| 3,468,549 | A * | 9/1969 | Wilson | 277/330 |
| 3,614,111 | A * | 10/1971 | Regan | 251/1.2 |
| 3,762,725 | A * | 10/1973 | Taylor | 277/330 |
| 4,265,424 | A | 5/1981 | Jones | |
| 4,423,775 | A * | 1/1984 | Wilson | 166/84.4 |
| 4,444,250 | A * | 4/1984 | Keithahn et al. | 166/84.4 |
| 4,550,895 | A | 11/1985 | Shaffer | |
| 5,333,832 | A | 8/1994 | Bartholomew et al. | |
| 5,944,110 | A | 8/1999 | Watts et al. | |
| 6,089,526 | A | 7/2000 | Olson | |
| 6,167,959 | B1 * | 1/2001 | Bassinger et al. | 166/84.2 |
| 6,547,002 | B1 * | 4/2003 | Bailey et al. | 166/84.4 |
| 6,588,502 | B2 * | 7/2003 | Nice | 166/84.4 |
| 6,857,634 | B2 | 2/2005 | Araujo | |
| 6,955,357 | B2 | 10/2005 | Griffin et al. | |
| 7,926,560 | B2 * | 4/2011 | Bailey et al. | 166/84.4 |
| 8,028,750 | B2 * | 10/2011 | Hughes et al. | 166/250.01 |
| 2002/0074131 | A1 * | 6/2002 | Jones et al. | 166/379 |

* cited by examiner

*Primary Examiner* — David Andrews
*Assistant Examiner* — Elizabeth Gitlin
(74) *Attorney, Agent, or Firm* — Buskop Law Group PC; Wendy Buskop

(57) ABSTRACT

A stripper blow out preventer for oil field equipment, wherein the stripper blow out preventer can include a housing with a bore. The housing can have an open port and close port for accepting the hydraulic fluid, and a grease port for accepting grease. An annular recess of the housing can be in communication with the bore. A retainer ring can be engaged in the annular recess. A piston can be disposed in the annular recess. A seal element can be disposed in the annular recess between the retainer ring and the piston, and can have a thru bore. An insert can be engaged with the retainer ring. When the close port is pressurized, the piston can press against the seal element to form a seal against the oil field equipment. When the open port is pressurized, the piston can move to relax the seal element.

17 Claims, 4 Drawing Sheets

STRIPPER BLOW OUT PREVENTER FOR SMALL DIAMETER OIL FIELD TUBING OR SMALL DIAMETER POLISHED RODS

FIELD

The present embodiments generally relate to a stripper blow out preventer for small diameter oil field tubing or small diameter polished rods usable with oil field equipment.

BACKGROUND

A need exists for a high pressure blow out preventer usable with a variety of small diameter oil field equipment, such as coiled tubing, polished rods, and lubricators for oil field equipment.

The present embodiments meet these needs.

BRIEF DESCRIPTION OF THE FIGURES

The detailed description will be better understood in conjunction with the accompanying drawings as follows.

Figure 1:
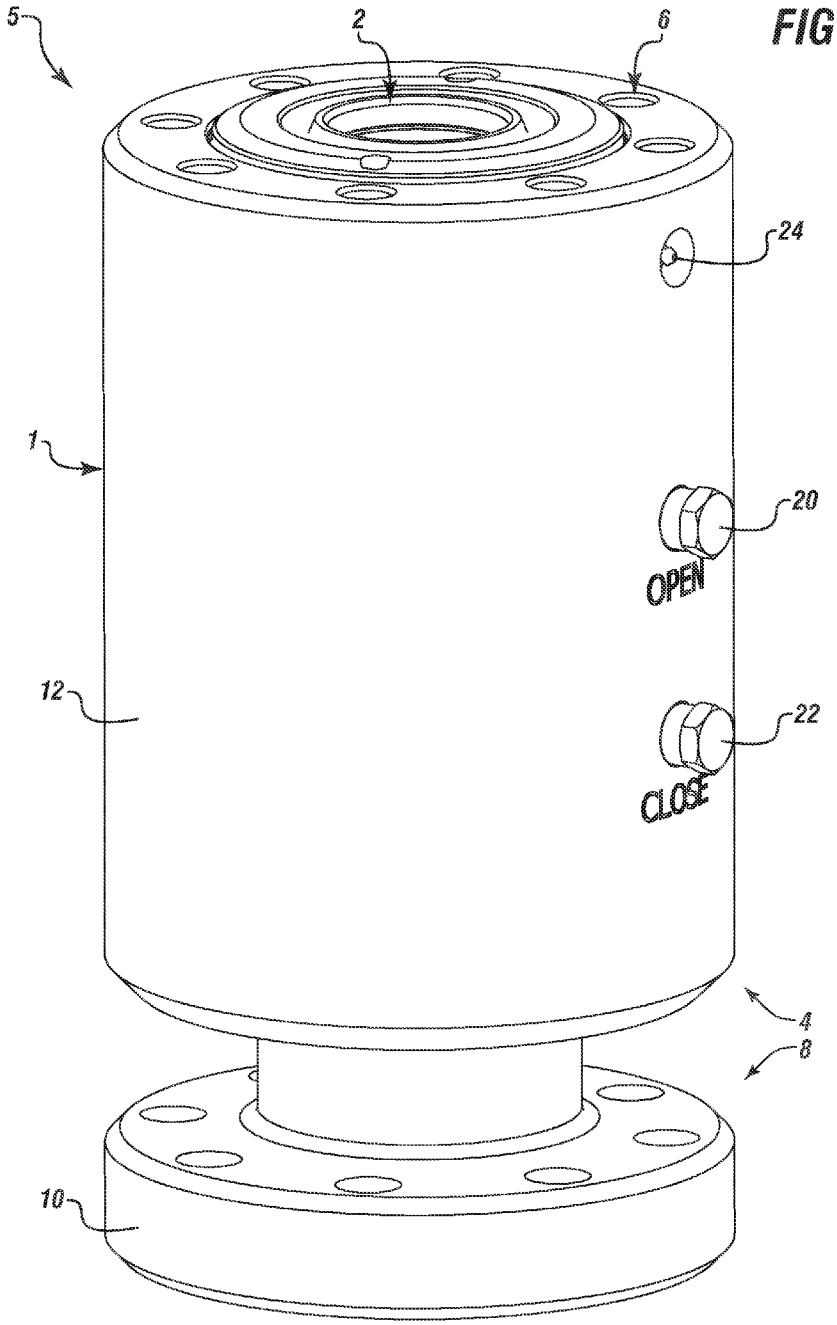
FIG. 1 is a perspective view of the stripper blow out preventer.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a stripper blow out preventer for small diameter oil field tubing or small diameter polished rods.

The stripper blow out preventer can include a housing with a longitudinal bore for engaging oil field work over equipment or oil field stimulation equipment, such as coiled tubing, polished rods, and lubricators for oil field equipment.

The oil field equipment can have a diameter ranging from about 1 inch to about 3.5 inches.

The housing can have an upper housing portion having a studded American Petroleum Institute (API) connection, and a lower housing portion having an API flanged connection.

The studded API connection, the API flanged connection, or combinations thereof can be configured to accommodate oil field equipment having: a $1\frac{13}{16}$ inch diameter connection, a $2\frac{1}{16}$ inch diameter connection, a $2\frac{9}{16}$ inch diameter connection, a $3\frac{1}{16}$ inch diameter connection, or a $4\frac{1}{16}$ inch diameter connection.

The stripper blow out preventer can include an open port in the housing for accepting hydraulic fluid.

The stripper blow out preventer can include a close port in the housing for accepting hydraulic fluid.

The stripper blow out preventer can include a grease port in the housing for allowing grease to lubricate housing threads in the housing.

The stripper blow out preventer can include a dual diameter annular recess having a first diameter and a second diameter. The first diameter can be from about 30 percent to about 50 percent larger than the second diameter. The dual diameter annular recess can be in fluid communication with the longitudinal bore.

The stripper blow out preventer can include a dual threaded retainer ring. The dual threaded retainer ring can include inner threads and outer threads. The outer threads can engage the housing threads of the housing.

The dual threaded retainer ring can include a beveled seal surface. The dual threaded retainer ring can be threadably engaged with the housing within the dual diameter annular recess.

The dual threaded retainer ring can also include a first inner seal surface, a second inner seal surface, and an outer sealing surface.

A piston with a piston beveled seal surface and a piston bottom edge can be disposed in the dual diameter annular recess.

The piston can have a first diameter portion for sealing against the second diameter of the dual diameter annular recess in the housing.

The piston can have a second diameter portion for sealing against the second inner seal surface of the dual threaded retainer ring.

The piston can have a third diameter portion for sealing against the first diameter portion of the dual diameter annular recess in the housing.

The first diameter portion of the piston can be smaller than the second diameter portion of the piston. The second diameter portion of the piston can be smaller than third diameter portion of the piston.

A radially expandable resilient seal element can be disposed in the dual diameter annular recess between the dual threaded retainer ring and the piston. The radially expandable resilient seal element can have a resilient seal element top beveled seal surface and a resilient seal element bottom beveled seal surface.

The radially expandable resilient seal element can have a resilient seal element thru bore having a diameter identical to the diameter of oil field work over equipment, oil field stimulation equipment, or other oil field equipment.

The radially expandable resilient seal element can have a plurality of ridges extending into the resilient seal element thru bore to seal with the oil field equipment.

The radially expandable resilient seal element can be made of a compressible elastomeric material, such as hydrogenated nitrile butadiene rubber.

The radially expandable resilient seal element can have a side planar face that seals against the second inner seal surface of the dual threaded retainer ring between the resilient seal element top beveled seal surface and the resilient seal element bottom beveled seal surface. The resilient seal element top beveled seal surface and the resilient seal element bottom beveled seal surface can be disposed at an angle of 135 degrees from the side planar face.

An insert, which can be a replaceable insert, can threadably engage the inner threads of the dual threaded retainer ring. The replaceable insert can have a diameter ranging from about 1 inch to about 3.5 inches, and can be configured to accommodate different size diameters of oil field equipment within the housing. As such, the same sized housing can be used for sealing different diameter pieces of oil field equipment.

The replaceable insert can have a first seal face that seals against the first inner seal surface of the dual threaded retainer ring.

The replaceable insert can have insert threads that engage the inner threads of the dual threaded retainer ring, and an insert beveled edge that seals against the resilient seal element top beveled seal surface.

The replaceable threaded insert can have an insert inner face that is oriented towards the longitudinal bore.

The replaceable threaded insert can have an installation pocket that can be used to torque the replaceable insert into the inner threads of the dual threaded retainer ring.

One or more embodiments of the stripper blow out preventer can include a plurality of piston type seals sealing between the first diameter of the housing and the piston. Piston seals can also be disposed between the dual threaded retainer ring and the replaceable threaded insert. A piston seal can be disposed between the dual threaded retainer ring and the housing.

A rod seal can be disposed between the dual threaded retainer ring and the piston, and a plurality of rod seals can be disposed between the piston and the housing.

In operation, when the close port is pressured, the piston can move axially in a first direction in the longitudinal bore. The piston can press against the radially expandable resilient seal element to create a high pressure seal against the oil field equipment in the longitudinal bore.

When the open port is pressurized, the piston can move axially in a second direction opposite the first direction to relax the radially expandable resilient seal element from the oil field equipment in the longitudinal bore. In one or more embodiments, the close port and the open port can be hydraulically operated.

Turning now to the Figures, FIG. 1 depicts a perspective view of the stripper blow out preventer 5.

The stripper blow out preventer 5 can have a housing 1 with an outer surface 12. The housing 1 can be made of carbon steel.

In one or more embodiments, the housing 1 can be made of multiple different materials to provide the housing 1 with multiple different physical properties. For example, the housing 1 can be made of a first material configured to withstand sour service and cold climates, while also being made of a second material configured to withstand hot climates.

The housing 1 can have an upper housing portion 4 with a studded American Petroleum Institute (API) connection 6.

The housing 1 can also have a lower housing portion 8 with an API flanged connection 10. The lower housing portion 8 can be connected to the upper housing portion 4.

The studded API connection 6, the API flanged connection 10, or combinations thereof can be configured to accommodate oil field equipment having: a 1 13/16 inch diameter connection, a 2 1/16 inch diameter connection, a 2 9/16 inch diameter connection, a 3 1/16 inch diameter connection, and a 4 1/16 inch diameter connection.

A longitudinal bore 2 can be disposed through the housing 1, and can engage small diameter oil field equipment, such as oil field work over equipment or oil field stimulation equipment. The oil field work over equipment or oil field stimulation equipment can be coiled tubing, polished rods, lubricators, or combinations thereof. The oil field work over equipment or oil field stimulation equipment can have diameters ranging from about one inch to about four inches.

An open port 20 can be disposed in the housing 1 through the outer surface 12. The open port 20 can receive a hydraulic fluid.

A close port 22 can be disposed in the housing 1 through the outer surface 12. The close port 22 can receive hydraulic fluid.

A grease port 24 can be disposed in the housing 1 through the outer surface 12. The grease port 24 can receive grease from a grease source. For example, grease that passes the Shrimp Test for use in the ocean can be used.

Figure 2:
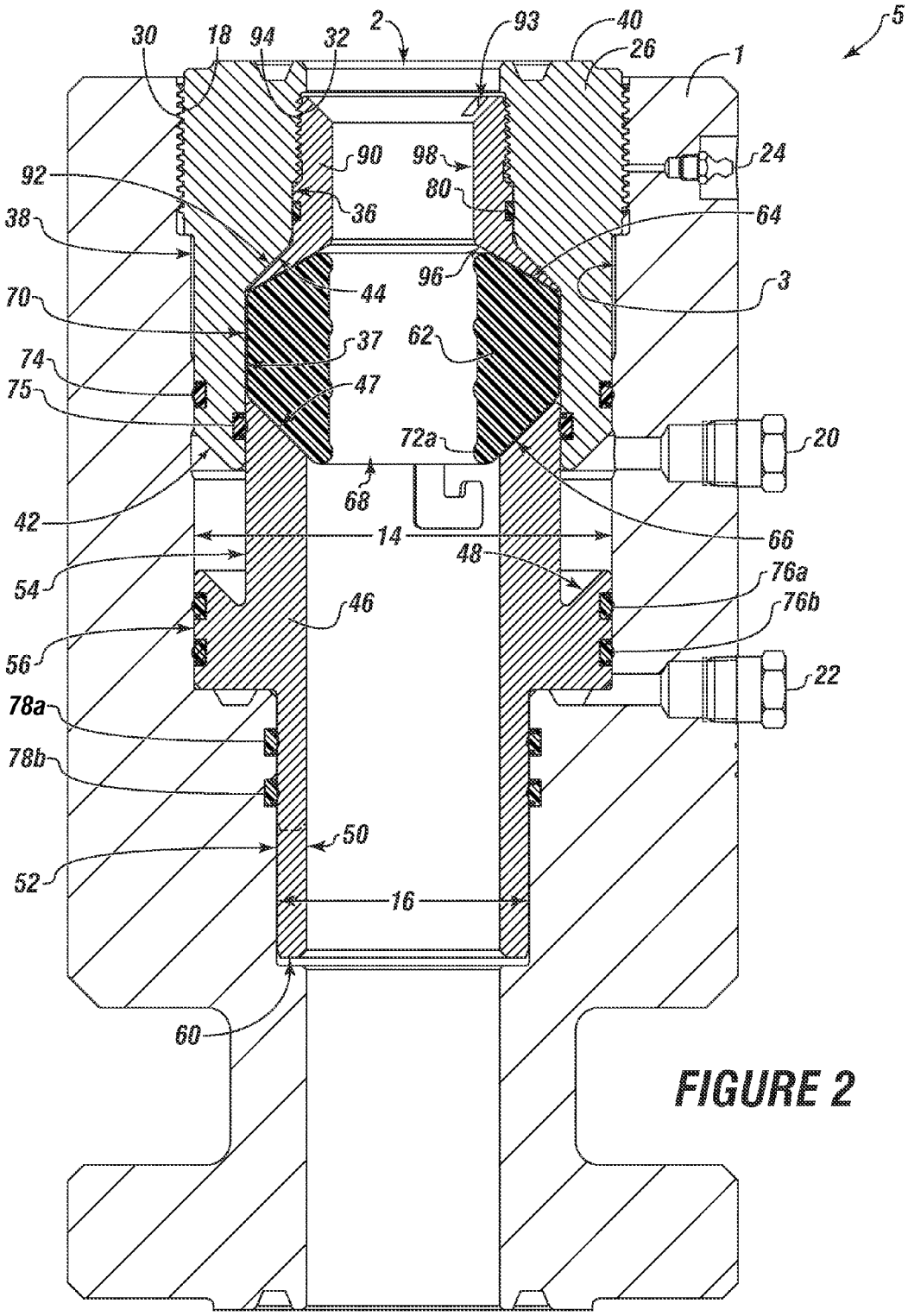
FIG. 2 is a cross sectional view of the stripper blow out preventer.

FIG. 2 depicts a cross sectional view of the stripper blow out preventer 5.

A recess 3, also called a dual diameter annular recess, can surround the longitudinal bore 2. The recess 3 can have a first diameter 14 and a second diameter 16. The first diameter 14 can be from about 30 percent to about 50 percent larger than the second diameter 16.

Housing threads 18 can be formed on at least a portion of the first diameter 14. The housing threads 18 can engage with outer threads 30 on a retainer ring 26, also called a dual threaded retainer ring, thereby attaching the housing 1 to the retainer ring 26.

The grease port 24, the open port 20, and the close port 22 are shown extending through the housing 1.

The grease port 24 can receive grease from a source external to the housing 1, and can flow the grease into the housing 1 at or proximate the housing threads 18 to lubricate the housing threads 18.

The retainer ring 26 can have inner threads 32 for attaching the retainer ring 26 to an insert 90, also called a replaceable insert.

The retainer ring 26 can have a first inner seal surface 36 to form a seal with the insert 90. The retainer ring 26 can have a second inner seal surface 37 to form a seal with a seal element 62, also called a radially expandable resilient seal element.

The retainer ring 26 can have an outer sealing surface 38 to form a seal with the housing 1. The retainer ring 26 can have a top 40, a bottom 42, and a beveled seal surface 44.

The insert 90 can be disposed in the longitudinal bore 2 between the retainer ring 26 and the seal element 62.

The insert 90 can be made of the same material as the housing 1, or another material.

The insert 90 can have a first seal face 92 to form a seal against the first inner seal surface 36.

The insert 90 can have insert threads 94 engaged with the inner threads 32.

The insert 90 can have an insert beveled edge 96 that can form a seal with a resilient top seal surface 64, also called a resilient seal element top beveled seal surface, of the seal element 62.

The insert 90 can have an insert inner face 98, which can be oriented towards the longitudinal bore 2.

The insert 90 can have an installation pocket 93, which can be used to torque the insert 90 into the inner threads 32. In one or more embodiments, the installation pocket 93 can have a depth ranging from about one inch to about two inches, and a width ranging from about 1/4 of an inch to about 3/4 of an inch.

In operation, the insert 90 can be replaced with another sized insert, allowing the diameter of the longitudinal bore 2 to be widened or narrowed to fit different sizes of oil field equipment. The diameter of the longitudinal bore 2 can be configured to range from about one inch to about four inches to accommodate different sizes of oil field equipment within the housing 1. Therefore, a single housing 1 can be used to seal different diameter pieces of oil field equipment, lowering costs and simplifying replacement of the insert 90.

The seal element 62 can be positioned in the first diameter 14 portion of the recess 3. The seal element 62 can be made of an elastomeric material that is compressible, such as hydrogenated nitrile butadiene rubber. The seal element 62 can have a thru bore 68 centrally formed therein.

The seal element 62 can have the resilient top seal surface 64 and a resilient bottom seal surface 66, also called a resilient seal element bottom beveled seal surface. The resilient bottom seal surface 66 can be disposed opposite the resilient top seal surface 64.

The seal element 62 can have a side planar face 70 disposed between the resilient top seal surface 64 and the resilient bottom seal surface 66. The side planar face 70 can form a seal against the second inner seal surface 37.

The resilient top seal surface 64 and the resilient bottom seal surface 66 can both be disposed at an angle to the side planar face 70 ranging from about 100 degrees to about 160 degrees. In one or more embodiments, the resilient top seal surface 64 and the resilient bottom seal surface 66 can both be disposed at an angle of 135 degrees from the side planar face 70.

In one or more embodiments, a plurality of ridges, such as ridge 72*a*, can be disposed around an inner surface of the thru bore 68 and can extend into the thru bore 68. The plurality of ridges can include from about two ridges to about eight ridges.

In one or more embodiments, the seal element 62 can have a length ranging from about two inches to about four inches and a width ranging from about three inches to about four inches.

The stripper blow out preventer 5 can have a piston 46. The piston 46 can have a first piston beveled seal surface 47 and a second piston beveled seal surface 48.

The piston 46 can have a first diameter portion 52 for sealing within the second diameter 16 of the recess 3.

The piston 46 can have a second diameter portion 54 for sealing against the second inner seal surface 37 during operation.

The piston 46 can have a third diameter portion 56 for sealing against the first diameter 14 of the recess 3.

The first diameter portion 52 can be smaller than the second diameter portion 54, and the second diameter portion 54 can be smaller than the third diameter portion 56.

The piston 46 can also have a piston bottom edge 60 and an inner planar face 50.

The stripper blow out preventer 5 can have one or more seals. For example, a plurality of first seals, such as first seal 76*a* and first seal 76*b*, can seal between the piston 46 and the housing 1 within the first diameter 14.

A second seal 80 can seal between the insert 90 and the retainer ring 26. A third seal 74 can seal between the retainer ring 26 and the housing 1. A fourth seal 75 can seal between the retainer ring 26 and the piston 46.

A plurality of fifth seals, such as fifth seal 78*a* and fifth seal 78*b*, can seal between the piston 46 and the housing 1 within the second diameter 16.

The various seals usable with the stripper blow out preventer 5 can be rod type seals and/or piston type seals, such as those available from OEM Components from Houston, Tex. or U-tex Industries, of Columbus, Tex.

Figure 3A:
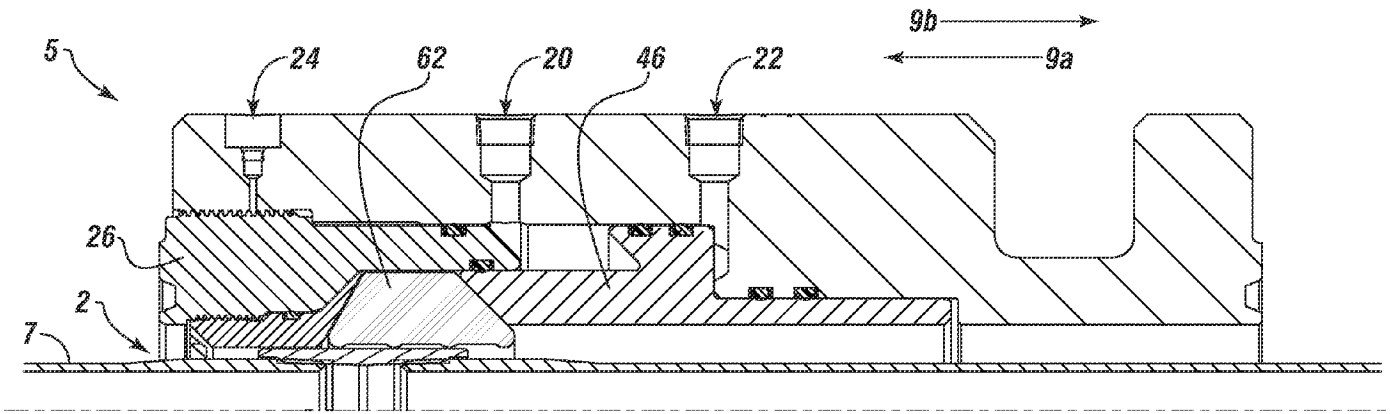
FIGS. 3A-3C depict the stripper blow out preventer at various stages of operation.
Figure 3B:
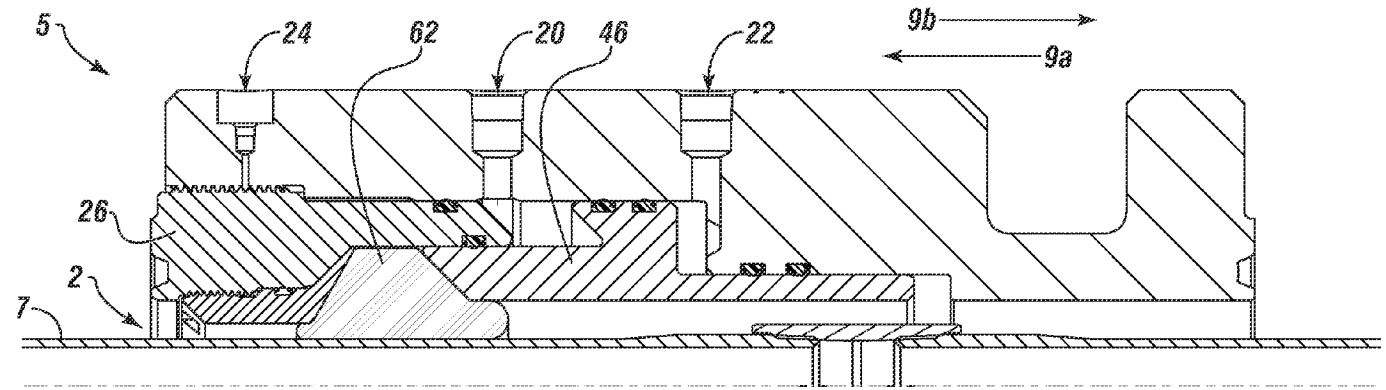
Figure 3C:
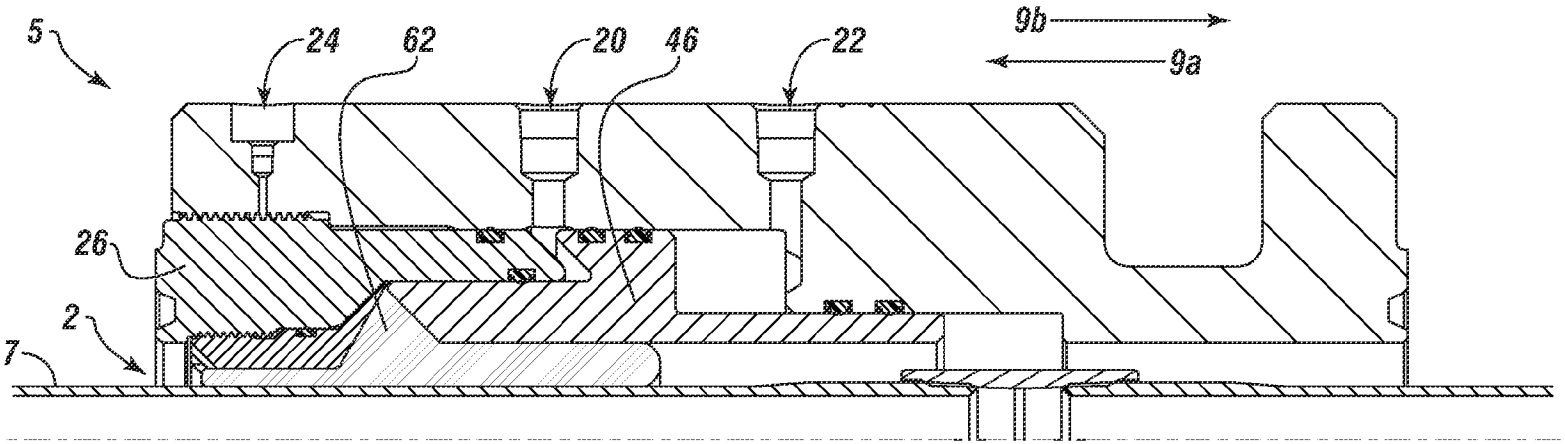

FIGS. 3A-3C depict the stripper blow out preventer 5 at different stages in operation.

FIG. 3A depicts the stripper blow out preventer 5 in an opened or relaxed configuration.

The stripper blow out preventer 5 has an oil field tubing or polished rod 7 disposed within the longitudinal bore 2.

The piston 46 is shown in a retracted configuration, and the seal element 62 is depicted in a relaxed configuration.

In operation, the open port 20 can receive hydraulic fluid, such as from a hydraulic fluid source outside the housing. The hydraulic fluid can flow through the open port 20 to the retainer ring 26 and the piston 46.

In one or more embodiments, the hydraulic fluid can be an environmentally friendly hydraulic fluid that passes the National Oceanic and Atmospheric Administration (NOAA) Shrimp Test for reduced levels of toxicity.

FIG. 3B shows the stripper blow out preventer 5 in a partially stoked configuration.

The close port 22 can receive hydraulic fluid and flow the hydraulic fluid to the piston 46.

When the close port 22 is pressured by the hydraulic fluid, the piston 46 can move axially in a first direction 9*a* within the longitudinal bore 2.

The piston 46 can press against the seal element 62 to create a high pressure seal against the oil field tubing or polished rod 7 in the longitudinal bore 2.

The piston 46 is depicted having partially moved towards the retainer ring 26 and the seal element 62 relative to the position of the piston 46 in FIG. 3A.

The seal element 62 is depicted in a partially compressed configuration, with the seal element 62 forming a seal with the oil field tubing or polished rod 7.

FIG. 3C shows the stripper blow out preventer 5 in a fully stoked configuration.

The piston 46 is shown fully moved in the first direction 9*a* within the longitudinal bore 2 towards the seal element 62.

The seal element 62 is depicted in a fully compressed configuration, with the seal element 62 forming the high pressure seal against the oil field tubing or polished rod 7.

When the open port 20 is pressurized by the hydraulic fluid, the piston 46 can move axially in a second direction 9*b* opposite the first direction 9*a*, which can allow the seal element 62 to relax from the oil field tubing or polished rod 7 and return to the relaxed configuration depicted in FIG. 3A.

In one or more embodiments, the housing can be adapted to support high pressure seals configured to sustain pressures ranging from about 2000 pounds per square inch (psi) to about 15,000 psi, such as when the stripper blow out preventer 5 is used to form high pressure seals around tubing that is 2⅞ inch in diameter.

The grease port 24 can be used to grease the housing threads before stroking the piston 46, during stroking of the piston 46, or after stroking the piston 46.

While these embodiments have been described with emphasis on the embodiments, it should be understood that within the scope of the appended claims, the embodiments might be practiced other than as specifically described herein.

What is claimed is:

1. A stripper blow out preventer for small diameter oil field tubing or small diameter polished rods, wherein the stripper blow out preventer comprises:

a. a housing with a longitudinal bore for engaging oil field work over equipment or oil field stimulation equipment;

b. an open port in the housing for accepting hydraulic fluid;

c. a close port in the housing for accepting the hydraulic fluid;

d. a grease port in the housing for allowing grease to lubricate housing threads in the housing;

e. a dual diameter annular recess having a first diameter differing from a second diameter, wherein the dual diameter annular recess is in fluid communication with the longitudinal bore;

f. a dual threaded retainer ring threadably engaged in the dual diameter annular recess comprising: inner threads, outer threads, and a beveled seal surface, wherein the outer threads are engaged with the housing threads;

g. a piston with a piston beveled seal surface, wherein the piston is disposed in the dual diameter annular recess;

h. a radially expandable resilient seal element with a resilient seal element top beveled seal surface and a resilient seal element bottom beveled seal surface, wherein the radially expandable resilient seal element is disposed in the dual diameter annular recess, wherein the resilient seal element bottom beveled seal surface is engaged with the piston beveled seal surface, and wherein the radially expandable resilient seal element has a thru bore with a diameter identical with the diameter of the oil field work over equipment or oil field stimulation equipment;

i. a replaceable insert threadably engaged with the inner threads of the dual threaded retainer ring, wherein insert threads located on an upper portion of the replaceable insert are engaged with the inner threads of the dual threaded retainer ring, and a beveled lower portion is engaged with the resilient seal element top beveled seal surface, and wherein the replaceable insert is configured to accommodate oil field equipment within the housing having different diameter sizes;

j. a plurality of first seals disposed between the first diameter of the dual diameter annular recess and the piston;

k. a second seal disposed between the dual threaded retainer ring and the replaceable insert;

l. a third seal disposed between the dual threaded retainer ring and the housing;

m. a fourth seal disposed between the dual threaded retainer ring and the piston; and n. a plurality of fifth seals disposed between the piston and the housing, wherein when the close port is pressurized by hydraulic fluid the piston is configured to move axially in a first direction in the longitudinal bore and press against the radially expandable resilient seal element to form a high pressure seal against the oil field work over equipment or oil field stimulation equipment in the longitudinal bore, and wherein when the open port is pressurized by hydraulic fluid the piston is configured to move axially in a second direction opposite the first direction to relax the radially expandable resilient seal element from the oil field work over equipment or oil field stimulation equipment in the longitudinal bore.

2. The stripper blow out preventer of claim 1, wherein the first diameter is from thirty percent larger to fifty percent larger than the second diameter.

3. The stripper blow out preventer of claim 1, wherein the radially expandable resilient seal element has a plurality of ridges extending into the thru bore configured to seal the oil field work over equipment or oil field stimulation equipment.

4. The stripper blow out preventer of claim 1, wherein the close port and the open port are hydraulically operated.

5. The stripper blow out preventer of claim 1, wherein the high pressure seal on the oil field work over equipment or oil field stimulation equipment ranges from 2000 pounds per square inch to 15,000 pounds per square inch.

6. The stripper blow out preventer of claim 1, wherein the housing comprises:

a. an upper housing portion having a studded connection; and b. a lower housing portion having a flanged connection.

7. The stripper blow out preventer of claim 6, wherein the studded connection, the flanged connection, or combinations thereof are configured to accommodate oil field equipment having: a 1 13/16 inch diameter connection, a 2 1/16 inch diameter connection, a 2 9/16 inch diameter connection, a 3 1/16 inch diameter connection, or a 4 1/16 inch diameter connection.

8. The stripper blow out preventer of claim 1, wherein the piston comprises:

a. a first diameter portion for sealing against the second diameter of the dual diameter annular recess;

b. a second diameter portion for sealing against a second inner seal surface of the dual threaded retainer ring, wherein the first diameter portion is smaller than the second diameter portion;

c. a third diameter portion for sealing against the first diameter of the dual diameter annular recess, wherein the second diameter portion is smaller than the third diameter portion; and d. a piston bottom edge.

9. The stripper blow out preventer of claim 1, wherein the radially expandable resilient seal element is made of a compressible elastomeric material.

10. The stripper blow out preventer of claim 9, wherein the compressible elastomeric material is hydrogenated nitrile butadiene rubber.

11. The stripper blow out preventer of claim 9, wherein the radially expandable resilient seal element further comprises a side planar face disposed between the resilient seal element top beveled seal surface and the resilient seal element bottom beveled seal surface, wherein the side planar face seals against the second inner seal surface.

12. The stripper blow out preventer of claim 11, wherein the resilient seal element top beveled seal surface and the resilient seal element bottom beveled seal surface are disposed at an angle of one hundred thirty five degrees from the planar side face.

13. The stripper blow out preventer of claim 1, wherein the replaceable insert has a first seal face sealed against a first inner seal surface of the dual threaded retainer ring.

14. The stripper blow out preventer of claim 1, wherein the replaceable insert further comprises an insert inner face.

15. The stripper blow out preventer of claim 1, wherein the replaceable insert further comprises an installation pocket configured to torque the replaceable insert into the inner threads.

16. The stripper blow out preventer of claim 1, wherein the dual threaded retainer ring further comprises a first inner seal surface, a second inner seal surface, and an outer sealing surface.

17. A stripper blow out preventer for oil field tubing, rods, and equipment, wherein the stripper blow out preventer comprises:

a. a housing with a bore for engaging oil field work over equipment or oil field stimulation equipment;

b. an open port in the housing for accepting hydraulic fluid;

c. a close port in the housing for accepting the hydraulic fluid;

d. a grease port in the housing for allowing grease to lubricate housing threads in the housing;

e. a dual diameter annular recess having a first diameter differing from a second diameter, wherein the dual diameter annular recess is in fluid communication with the bore;

f. a retainer ring threadably engaged in the dual diameter annular recess comprising: inner threads, outer threads, and a beveled seal surface, wherein the outer threads are engaged with the housing threads;

g. a piston with a piston beveled seal surface, wherein the piston is disposed in the dual diameter annular recess;

h. a radially expandable resilient seal element with a resilient seal element top beveled seal surface and a resilient seal element bottom beveled seal surface, wherein the radially expandable resilient seal element is disposed in the dual diameter annular recess, wherein the resilient seal element bottom beveled seal surface is engaged with the piston beveled seal surface, and wherein the radially expandable resilient seal element has a thru bore;

i. an insert threadably engaged with the inner threads of the retainer ring, wherein insert threads located on an upper portion of the insert are engaged with the inner threads of the retainer ring, and a beveled lower portion is engaged with the resilient seal element top beveled seal surface, and wherein the insert is configured to accommodate oil field equipment within the housing having different diameter sizes;

j. a plurality of first seals disposed between the first diameter of the dual diameter annular recess and the piston;

k. a second seal disposed between the retainer ring and the insert;

l. a third seal disposed between the retainer ring and the housing;

m. a fourth seal disposed between the retainer ring and the piston; and n. a plurality of fifth seals disposed between the piston and the housing, wherein when the close port is pressured by hydraulic fluid the piston is configured to move axially in a first direction in the bore and press against the radially expandable resilient seal element to form a high pressure seal against the oil field work over equipment or oil field stimulation equipment in the bore, and wherein when the open port is pressurized by hydraulic fluid the piston is configured to move axially in a second direction opposite the first direction to relax the radially expandable resilient seal element from the oil field work over equipment or oil field stimulation equipment in the bore.

* * * * *